US006367555B1

(12) United States Patent
Senyard, Sr. et al.

(10) Patent No.: US 6,367,555 B1
(45) Date of Patent: Apr. 9, 2002

(54) METHOD AND APPARATUS FOR PRODUCING AN OIL, WATER, AND/OR GAS WELL

(76) Inventors: Corley P. Senyard, Sr., 4640 Blue Bell Dr., Baton Rouge, LA (US) 70808; Thomas J. Senyard, Sr., 328 Autumn Oak Dr., Baton Rouge, LA (US) 70810

( * ) Notice: Subject to any disclaimer, the term of this patent is extended or adjusted under 35 U.S.C. 154(b) by 0 days.

(21) Appl. No.: 09/526,141

(22) Filed: Mar. 15, 2000

(51) Int. Cl.[7] ..... E21B 43/16
(52) U.S. Cl. ..... 166/370; 166/372
(58) Field of Search ..... 166/372, 370, 166/369

(56) References Cited

U.S. PATENT DOCUMENTS

| | | | | | |
|---|---|---|---|---|---|
| 1,067,868 | A | * | 7/1913 | Dunn | 166/372 |
| 1,554,444 | A | | 9/1925 | Loomis | 166/250 |
| 1,790,450 | A | | 1/1931 | Torrance | |
| 2,005,767 | A | | 6/1935 | Zublin | 166/21 |
| 2,034,798 | A | | 3/1936 | Clark | 166/2 |
| 3,090,316 | A | | 5/1963 | Montgomery | 103/52 |
| 3,215,087 | A | | 11/1965 | McLeod, Jr. | 103/232 |
| 3,873,238 | A | | 3/1975 | Elfarr | 417/54 |
| 4,223,724 | A | | 9/1980 | Levoni et al. | 166/68 |
| 4,267,885 | A | * | 5/1981 | Sanderford | 166/250 |
| 4,275,790 | A | | 6/1981 | Abercrombie | 166/314 |
| 4,345,647 | A | | 8/1982 | Carmichael | 166/66 |
| 4,390,061 | A | | 6/1983 | Short | 166/53 |
| 4,392,532 | A | * | 7/1983 | Raggio | 166/372 |
| 4,410,041 | A | | 10/1983 | Davies et al. | 166/250 |
| 4,478,288 | A | | 10/1984 | Bowyer | 166/372 |
| 4,480,697 | A | | 11/1984 | Goldaniga | 166/372 |
| 4,625,801 | A | | 12/1986 | McLaughlin | 166/267 |
| 4,711,306 | A | | 12/1987 | Bobo | 166/372 |
| 4,787,450 | A | | 11/1988 | Andersen et al. | 166/267 |
| 4,844,156 | A | | 7/1989 | Hesh | 166/263 |
| 5,033,550 | A | | 7/1991 | Johnson et al. | 166/372 |
| 5,211,242 | A | | 5/1993 | Coleman et al. | 166/372 |
| 5,337,828 | A | | 8/1994 | Jennings, Jr. | 166/372 |
| 5,345,655 | A | | 9/1994 | Bernhardt | 166/370 |
| 5,377,764 | A | | 1/1995 | Jennings, Jr. | 166/372 |
| 5,400,858 | A | * | 3/1995 | Blanchard et al. | 166/370 |
| 5,464,309 | A | | 11/1995 | Mancini et al. | 405/258 |
| 5,501,279 | A | | 3/1996 | Garg et al. | 166/372 |
| 5,547,021 | A | | 8/1996 | Raden | 166/250.07 |

(List continued on next page.)

*Primary Examiner*—Hoang Dang
(74) *Attorney, Agent, or Firm*—Garvey, Smith, Nehrbass & Doody, LLC

(57) ABSTRACT

The present invention provides a method of producing an oil, water, and gas well using a gas carrier/transport system to remove produced liquids and contained solids by altering the flow regime of the production fluids towards or into a flow regime in which gas is the continuous fluid (i.e., the rate of upflowing gas in the well is efficiently high in comparison with liquid production flow to generate plug flow, slug flow, froth flow, foam flow, annular flow, spray flow, and/or mist flow.) This is accomplished by use of supplemental gas flow (hydrocarbon or non-hydrocarbon) and/or stimulation of the production sand gas flow with a reduced pressure drop across the wall once near or in a gas-continuous flow regime. This invention can be applied to any gas, oil, and/or water well with insufficient formation gas pressure to prevent liquid buildup within the well during production. The present invention utilizes a second production pipe (or the annulus between the casing and the pipe), sized to transport compressed gas from the wellhead area down into the production liquid and into the production pipe. This flow of gas will cause the wall fluids to flow up the pipe by approaching or entering a gas-continuous flow regime. Once the new flow regimes have been achieved in the production pipe, supplemental gas may no longer be necessary due to increased formation gas flow without the high pressure drop which had been due to the column of liquid in the production pipe.

45 Claims, 7 Drawing Sheets

U.S. PATENT DOCUMENTS

| | | | | |
|---|---|---|---|---|
| 5,620,593 | A | 4/1997 | Stagner | 210/90 |
| 5,634,522 | A | 6/1997 | Hershberger | 166/372 |
| 5,671,813 | A | 9/1997 | Lima | 166/372 |
| 5,735,346 | A | 4/1998 | Brewer | 166/250.03 |
| 5,816,326 | A | 10/1998 | Slater | 166/369 |
| 5,839,514 | A | 11/1998 | Gipson | 166/384 |
| 5,893,414 | A | 4/1999 | Shaposhnikov | 166/191 |
| 5,906,241 | A | 5/1999 | Pehlivan et al. | 166/372 |
| 5,911,278 | A | 6/1999 | Reitz | 166/372 |

* cited by examiner

MANDHANE ET AL. HORIZONTAL FLOW REGIME MAP

AZIZ ET AL. VERTICAL FLOW REGIME MAP

METHOD AND APPARATUS FOR PRODUCING AN OIL, WATER, AND/OR GAS WELL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil, water, and gas well drilling and production. More particularly, the present invention relates to an improved method and apparatus for producing oil and gas from a well using a gas carrier/transport system to remove produced liquids and/or solids by altering the flow regime of the production fluids towards or into a flow regime in which gas is the continuous fluid (i.e. the rate of upflowing gas in the well is sufficiently high in comparison with liquid production flow to generate plug flow, slug flow, froth flow, foam flow, annular flow, spray flow, or mist flow.) This is accomplished by use of supplemental gas flow and/or stimulation of the production sands gas flow with a reduced pressure drop across the well itself. This invention can be applied to any gas, oil, and/or water well with insufficient formation gas pressure to prevent liquid buildup within the well during production. This invention can also be applied to any oil and/or water (liquid) well as a means of enhancing the well's production.

2. General Background of the Invention

Several patents have issued that are directed to oil, water, and gas well production. Many patents are directed to "gas lift" technology. In such a "gas lift" situation, a relatively small volume of gas is bubbled through the up-flowing hydrocarbon or non-hydrocarbon liquid, typically aided by or using valves, check valves, plungers, mandrels, or other mechanical devices "downhole" which are typically high maintenance devices. Some even refer to the necessity for "bottom of pipe" filters or screens to remove sand and silt from the production fluids in order to allow these mechanical devices to operate. Some refer to the use of such mechanical devices to minimize the required "lift gas".

All of the designs known to applicant and using these mechanical devices are designed to convert the well production from the bubble flow regime to the plug flow regime by use of these devices, not by gas alone. An early example of such a system is described in the Walter Loomis patent, U.S. No. Pat. 1,554,444 entitled "System for the Recovery of Mineral Oils". The '444 patent describes a system for causing produced hydrocarbon gas to be reintroduced into the oil well down through the casing, into a mixer, causing the gas to be mixed with the upflowing hydrocarbon liquid inside the production tubing. The heavier components of the hydrocarbon gas will dissolve under pressure back into the hydrocarbon liquid (probably including those hydrocarbons—propane and heavier), while the rest become mixed back into the oil in a finely divided form. Such an introducing of hydrocarbon gases into the hydrocarbon liquid cause the specific gravity of liquids to be lowered, thus causing the "lift". The lighter hydrocarbon gases are supposed to dissolve in the hydrocarbon liquid at the bottom of the well, enhancing the lift by reducing the specific gravity. As the pressure in the production tubing is reduced as the hydrocarbon liquid rises to the surface, the lighter hydrocarbon gases will return to the vapor phase and further enhance the lift effect. The Loomis patent directed to the need to lift hydrocarbon liquid and does not deal with the need to lift "produced water".

U.S. Pat. No. 1,790,450 entitled "Method and Apparatus for Operating Oil Wells" discloses a system of a mechanical means for causing produced hydrocarbon gas to build up pressure beneath a rubber plug, which will periodically rise and effectively "swab" the liquid hydrocarbon up the well pipe. This patent describes one of the early pumping type gas lifts. It uses a rubber plug or piston in the production tubing to lift the liquids out of the well by gas pressure under the piston.

In U.S. Pat. No. 2,005,767, issued to Zublin, there is disclosed a system for causing produced hydrocarbon gas to be mechanically and centrifugally separated from the hydrocarbon liquid down in the well pipe, the gas being returned to the formation and the oil being produced containing a minimum amount of gas.

U.S. Pat. No. 2,034,798 entitled "Method of Flowing Wells" discloses a system for causing produced hydrocarbon gas by multiple wells to be stored up, and possibly be pressure boosted for proper usage, and to be used as motive gas for depleted wells in the same area.

U.S. Pat. No. 3,090,316 issued to Norman Montgomery and entitled "Gas Lifting System" describes a system for causing produced hydrocarbon gas to lift a plurality of plungers throughout the production tubing, thus reducing the amount of time lost waiting for the plunger to return to the bottom for trapping a new volume of lift gas.

U.S. Pat. No. 3,215,087 issued to Harry O. McLeod, Jr. and entitled "Gas Lift System" describes a system for using gas injection, combined with intermittent slugs of a liquid which is both immiscible with the liquid being lifted from the well and does not adhere to the walls of the tubing and casing. This reduces the amount of liquid slippage by the slugs of lift gas.

U.S. Pat. No. 3,873,238 entitled "Method and Apparatus for Flowing Crude Oil from a Well", issued to Johnnie A. Elfarr, describes a system for causing steam and/or air to be pumped down into an older formation, whose formation pressure has been depleted, artificially boosting the formation pressure and causing the hydrocarbon liquid to flow upward toward the surface. Steam is especially beneficial as the oil viscosity is high, becoming reduced by the elevated temperature caused by the steam. This system uses multiple downhole valves to effect the claims.

U.S. Pat. No. 4,223,724 issued to Carlo F. Levoni et al. and entitled "Device for Cleaning, Widening and Repairing Wells of Drinking Water and Irrigation Water" describes a system for cleaning, widening and repairing of a water well.

U.S. Pat. No. 4,275,790 issued to Bolling A. Abercrombie, entitled "Surface Controlled Liquid Removal Method and System for Gas Producing Wells" describes a system for removal of accumulated production liquids. Assuming hydrocarbon gas is being produced from the well inside the casing, an internal production tubing, fitted with a loose fitting plunger, is used to periodically remove any collected liquids in the casing by shutting off the gas production while opening up the inner tubing, causing the gas to divert to the inner tubing, lifting the plunger and bringing the liquid up to the surface.

U.S. Pat. No. 4,345,647 issued to William C. Carmichael and entitled "Apparatus to Increase Oil Well Flow" describes a system for attaching a pump to the top of the production pipe, thus causing a vacuum on the production oil. This production pipe goes down into an oil sump, lower than the producing sands in the well casing.

U.S. Pat. No. 4,390,061 issued to Charles short and entitled "Apparatus for Production of Liquid from Wells" describes a system for causing gas to enter the production tubing through an aspirator into the hydrocarbon liquid contained therein. The bottom of the production tubing should be fitted with a sand screen to prevent entrainment of sand particles. Further up the drill tubing are one or more check valves to prevent downward flow of liquid.

U.S. Pat. No. 4,410,041 issued to Davis et al. and entitled "Process for Gas-Lifting Liquid from a Well by Injecting Liquid into the Well" describes a system for sealing off any particular zone of the formation with remotely-actuable packers, and using gas to lift any produced hydrocarbons from this very zone. The primary purpose is for formation and drill stem testing.

U.S. Pat. No. 4,478,288 issued to Michael L. Bowyer and entitled "Apparatus with Annulus Safety Valve Through Tubing Injection and Method of Use" describes a system for effecting safety control valving on both the gas supply line into the well casing and the return production tubing.

U.S. Pat. No. 4,480,697 entitled "Method and Apparatus for Converting an Oil Well to a Well with Effluent Raising by Gas-Lift", issued to Rene F. Goldaniga et al, describes a system for retrofitting an existing well, converting it to a gas lift system. Included in this patent is the required means for effecting the gas lift system while apparently providing superior flow shut-off capabilities.

U.S. Pat. No. 4,625,801 issued to Wayne C. McLaughlin et al. and entitled "Methods and Apparatus for Recovery of Hydrocarbons from Underground Water Tables" describes a system for using compressed air to lift hydrocarbon-contaminated groundwater up for collection and recovery.

U.S. Pat. No. 4,711,306 issued to Roy A. Bobo and entitled "Gas Lift System" describes a system for mixing pressurized injection gas with pressurized injection liquid, which is then pumped down the well, during which time the increase in pressure will cause the gas to become compressed. As this injection stream enters the production conduit near the bottom of the well bore, the gas will begin to expand, helping to lift the production fluid.

U.S. Pat. No. 4,787,450 issued to Gregory R. Anderson et al. and entitled "Gas Lift Process for Restoring Flow in Depleted Geothermal Reservoirs" describes a system for causing a gas lift process in a geothermal well.

U.S. Pat. No. 4,844,156 issued to Frank Hesh entitled "Method of Secondary Extraction of Oil from a Well" describes a system for repeatedly pressuring (super atmospheric) and depressuring (sub-atmospheric) the well formation by use of a sealed well casing.

U.S. Pat. No. 5,033,550 issued t Kenneth J. Johnson et al. and entitled "Well Production Method" describes a system, targeted specifically at the coal bed methane production, causing lift gas to be fed down injection tubing to a side pocket mandrel and then to a gas lift valve. The objective is to reduce the bottom hole pressure low enough so that the methane gas, impregnated into the coal fines, will be released and carried up by the lift gas to the well head.

U.S. Pat. No. 5,211,242 issued to Malcolm W. Coleman et al. entitled "Apparatus and Method for Unloading Production-Inhibiting Liquid from a Well" describes a system for collecting liquids in a chamber down in the well casing, to which two tubing strings are connected; Volumes of the liquid are intermittently lifted out of the well through one of the tubing strings in response to high pressure gas injected into the other tubing string.

U.S. Pat. No. 5,377,764 issued to Alfred R. Jennings, Jr. and entitled "Means of Injecting $CO_2$ into Circulation Tubing to Facilitate $CO_2$ Gas Lift" describes a system for introducing carbon dioxide gas into a viscous hydrocarbon heavy oil in the bottom casing of the well, allowing the carbon dioxide to dissolve in the oil, reducing it's viscosity and density, thus allowing the less viscous oil to be lifted up the production tubing by means of the gas lift effect with carbon dioxide.

A system for introducing carbon dioxide gas into a viscous hydrocarbon heavy oil in the bottom casing of the well, allowing the carbon dioxide to dissolve in the oil, reducing it's viscosity and density, thus allowing the less viscous oil to be lifted up the production tubing by means of the gas lift effect with carbon dioxide is described in U.S. Pat. No. 5,337,828, "Use of Carbon Dioxide for Gas-Lifting Heavy Oil", issued to Alfred R. Jennings, Jr.

A system for effecting a formation flooding to drive hydrocarbons up to the surface in a well is described in U.S. Pat. No. 5,345,655 issued to Bruno Bernhardt, entitled "Method of and Arrangement for Obtaining Liquids and/or Gases from Ground or Rock Layers".

U.S. Pat. No. 5,464,309 issued to Alfonso R. Mancini et al. describes a system for removing chemical contaminants from groundwater formations; it accomplishes this by a "tube within a tube" design, using one of the tubes to supply gas down to the underground site, while applying a vacuum to the other tube and lifting the contaminated water.

U.S. Pat. No. 5,501,279 issued to Arvind K. Garg et al. entitled "Apparatus and Method for Removing Production-Inhibiting Liquid from a Wellbore" describes a system for causing produced water to be removed from a wellbore by use of chambers, valves, and potentially retrievable wire-lines. With two production tubes attached to the chambers, one transporting pressurized lift gas down to the wellbore and the other lifting the produced water and methane gas, the pressure at the wellbore can be lowered enough to cause the entrained methane to be released from the carbonaceous subterranean formation.

U.S. Pat. No. 5,547,021 issued to Dennis P. Raden and entitled "Method and Apparatus for Fluid Production from a Wellbore" describes a system for assisting in lifting produced hydrocarbon liquid and produced water by means of a vacuum applied to the top of the production tubing; in addition, could possibly supplement lift by providing a lift gas fed from another production tubing to the bottom of the well. This lift gas could also be supplied by delivering down the well casing or the casing/tubing annulus. He also claims usage of eductors and valves.

U.S. Pat. No. 5,620,593 entitled "Multi-Stage In-Well Aerator", issued t Joseph C. Stagner, describes a system for utilizing in-casing aeration to remove VOC's from contaminated groundwater.

U.S. Pat. No. 5,634,522 entitled "Liquid level Detection for Artificial Lift System Control" issued to Michael D. Hershberger describes a system for detecting the liquid level in the well production tube, thus aiding in the determination when artificial lift becomes necessary.

U.S. Pat. No. 5,671,813 issued to Paulo Cesar Ribeiro Lima, entitled "Method and Apparatus for Intermittent Production of Oil with a Mechanical Interface" describes a system for essentially "pigging" oil out of a production tube "loop" by sending a mechanical interface down one tube, propelled by pressurized gas, and then up the other tube (which has collected some oil as a "sump"), eventually arriving back at the surface having delivered a slug of oil.

U.S. Pat. No. 5,735,346, entitled "Fluid Level Sensing for Artificial Lift Control Systems" and issued to James Robert Brewer, describes a system for determining the fluid level in a well casing for controlling artificial lift systems.

U.S. Pat. No. 5,816,326 issued to John P. Slater entitled "Uphole Disposal Tool for Water Producing Gas Wells" describes a system for pumping produced water up the casing by use of a mechanical device with multiple mandrels, utilizing production gas to cause the device to "pump".

U.S. Pat. No. 5,839,514, entitled "Method and Apparatus for Injection of Tubing into Wells" issued to Thomas C. Gipson describes a system for improved handling of "coiled tubing" in and out of a well.

U.S. Pat. No. 5,893,414 issued to Vladimir M. Shaposhnikov et al. discloses a device for intensification of hydrocarbon production and a hydrocarbons production system.

U.S. Pat. No. 5,906,241 issued to Mehmet Pehlivan et al, entitled "Method for Bubbling Extraction of Groundwater" describes a system for lifting contaminated groundwater by placing a hole in the extraction pipe a short distance above the static groundwater table, thus causing a bubbling action to aid in the lift of the groundwater by an applied vacuum at the head of the pipe. It is also claimed that this bubbling gas aids in the stripping of contaminants from the groundwater.

U.S. Pat. No. 5,911,278 issued to Donald D. Reitz, entitled "Calliope Oil Production System" describes a system for gas lifting oil from a well by using down-hole valve on the end of the production tubing, and either lifting the oil up some macaroni tubing, or by possibly using an optional plunger or other device to mechanically lift the oil up a production tube.

BRIEF SUMMARY OF THE INVENTION

The present invention provides an improved method and apparatus for producing oil, gas, and/or water from a well. The method of the present invention utilizes a gas carrier/transport system to remove produced liquids and/or solids by altering the flow regime of the production fluids towards or into a flow regime in which the gas is the continuous fluid. The rate of upflowing gas in the well is sufficiently high in comparison with liquid production flow to generate plug flow, slug flow, froth flow, foam flow, annular flow, spray flow, or mist flow. The method of the present invention is accomplished by use of supplemental gas flow and/or stimulation of the production sands gas flow with a reduced pressure drop across the well itself. The present invention can be applied to any oil, gas and/or water well with insufficient formation gas pressure to prevent liquid buildup within the well during production. This invention can also be applied to any oil and/or water (liquid) well as a means of enhancing the well's production.

BRIEF DESCRIPTION OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

Figure 1:
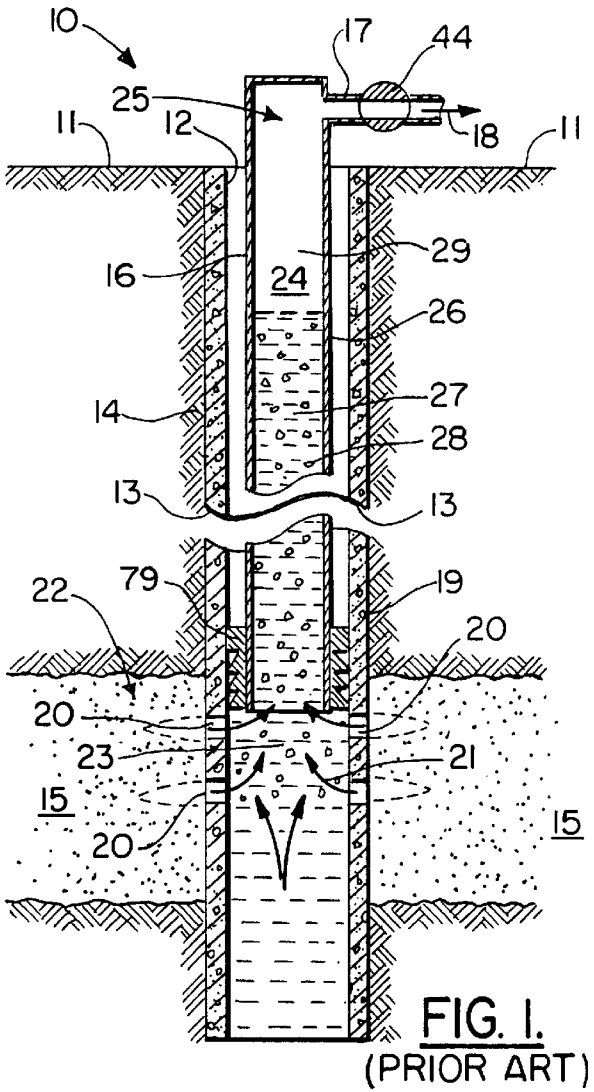
FIG. 1. (PRIOR ART)
FIG. 1 shows a cross section of a typical prior art well, showing the well production pipe partially filled with liquid (oil and/or water)

FIG. 1 shows a prior art type well designated generally by the numeral 10. Well 10 is shown in relation to the earth's surface 11. The well 10 is comprised of a borehole 14 that contains a well casing 12 that can be surrounded by a layer of concrete 13.

Deep into the earth, production sands 15 produce oil, water, and/or gas via a plurality of well perforations 20. Production pipe 16 is placed inside of casing 12. The production pipe 16 has a lower end portion that extends to a level adjacent production sands 15, as shown in FIG. 1. At this location, perforations 20 cut through casing 12 and its concrete layer 13 enable oil, gas, and/or water to flow under pressure via perforations 20 into production pipe 16.

In FIG. 1, arrows 21 schematically illustrate production flow from production sands 15 into production pipe 16. A packer 19 is typically placed in between well casing 12 and production pipe 16 as shown. The packer 19 is located at an elevational position above perforations 20 so that the packer 19 prevents the flow of oil or gas upwardly in the annulus or space in between casing 12 and production pipe 16. At the upper end portion of production pipe 16 there is provided a well head comprised of piping and valves that can include a lateral flow line 17 that receives production as indicated by arrow 18 as the well produces.

In FIG. 1, various pressure reference points 22–25 are shown. The well in FIG. 1 has a liquid content indicated by the numeral 27. This liquid content 27 can include water and/or oil. This liquid rises to level 26 in production pipe 16.

FIG. 1 thus shows a cross section of a typical well 10, but also showing the well production pipe 16 partially filled with liquid 27 (oil and/or water) having liquid level 26. Gas bubbles 28 rise up through the "column" of liquid 27 with the liquid 27 being the "continuous phase", and the gas 28 as the "discontinuous phase". Above liquid level 26 is gas, but can also include liquid droplets 29.

The minimum possible pressure drop limiting the production of hydrocarbons from the well is pressure from the production sands (reference numeral 22) to the inside of the well casing (reference numeral 23), plus the pressure drop which would exist between the pressure at 23 and at the wellhead (reference numeral 25), and assuming the production pipe contained only gas with no standing liquid. However, since wells can also have a standing "column of liquid", production is also limited by the additional pressure drop incurred due to the column of liquid 27, calculated at the top of the liquid at level 26(pressure point reference numeral 24) minus the pressure at 23 inside the well casing.

And in many cases, this additional pressure drop from 24 to 23 is much greater than the minimum possible pressure drop, restricting hydrocarbon production to a mere fraction of what would otherwise be possible. In other cases, the column of liquid rises to a height such that the pressure drop, from 23 to 24 to 25 equals the inherent production sands pressure minus the pressure drop from 22 to 23. In such a case, the well no longer produces hydrocarbons, and the well is said to be "watered up", "flooded", or just "dead".

Figure 2:
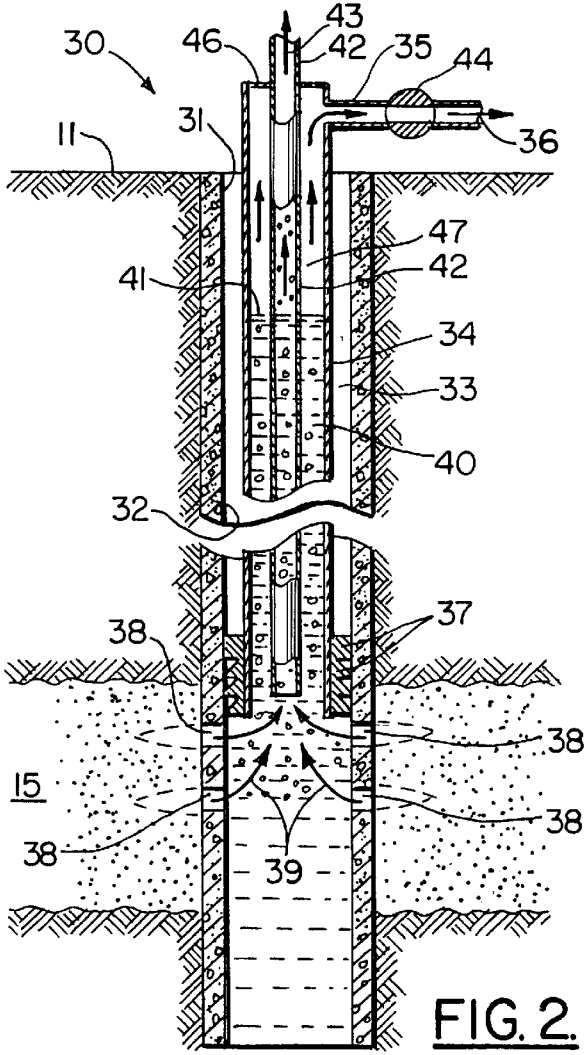
FIG. 2 is a schematic elevation view of a first embodiment of the apparatus of the present invention and showing the method of the present invention.
Figure 3:
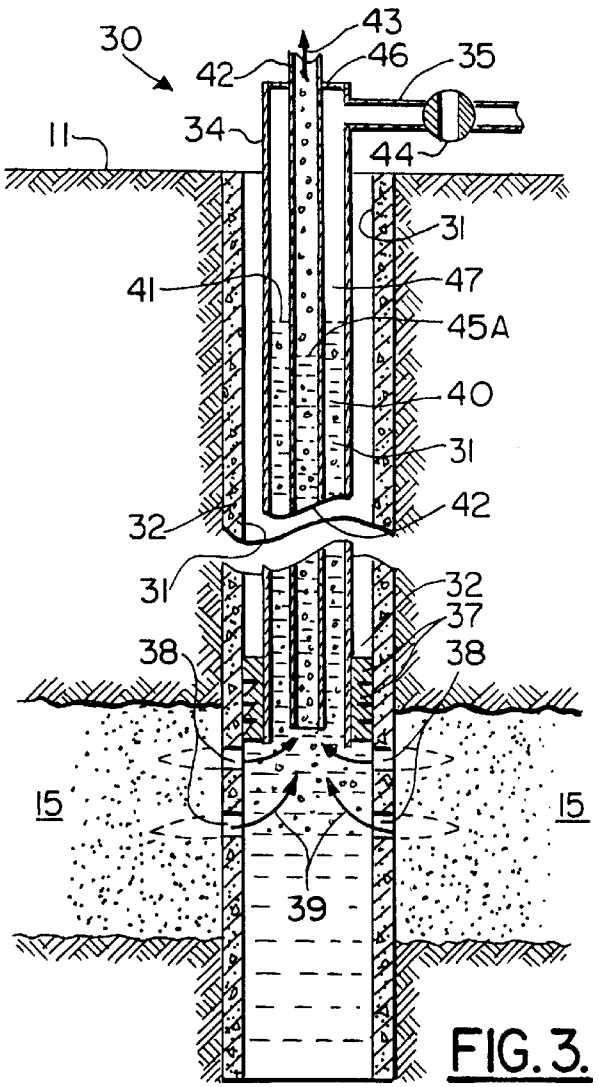
FIG. 3 is a sectional elevation view of a second embodiment of the apparatus of the present invention showing the production valve on the annulus in a closed position and showing a second embodiment of the method of the present invention.
Figure 4:
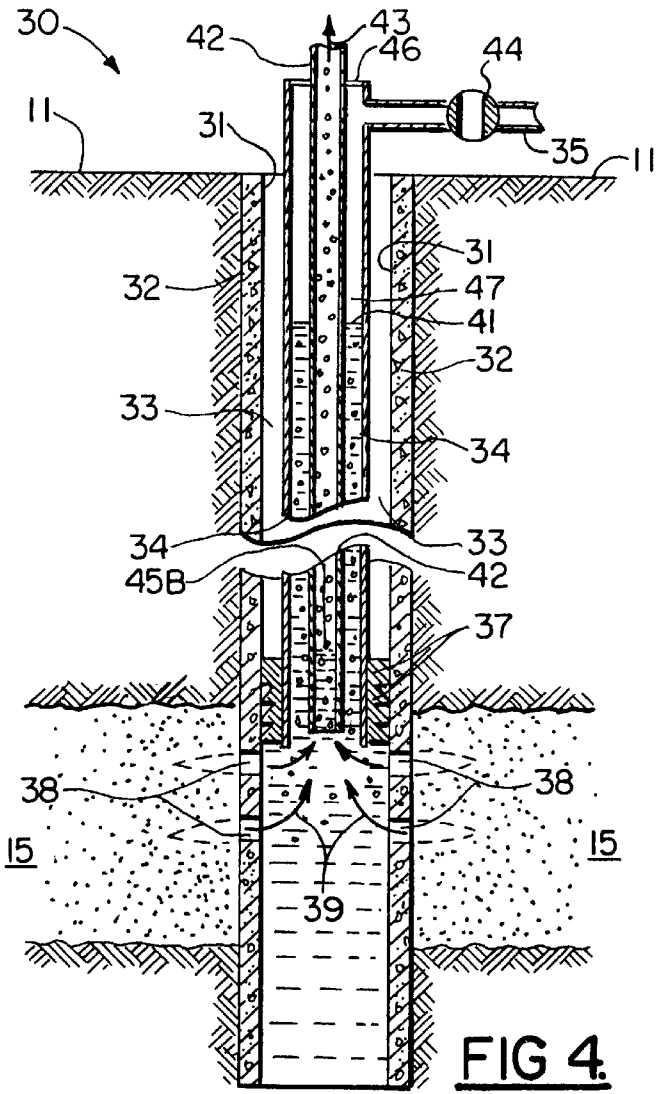
FIG. 4 is another sectional elevation view of the second embodiment of the apparatus of the present invention and showing the method of the present invention.

The present invention provides an improved method and apparatus for increasing production of a well by eliminating the column of liquid 27 and thus it's pressure drop which often can approach or exceed the inherent production sands pressure wherein the well no longer produces hydrocarbons. The apparatus and method of the present invention as shown in FIG. 2–4, designated generally by the numeral 30. Well 30 in FIGS. 2–4 includes a well casing 31 surrounded by concrete layer 32 in bore hole 33. Packer 37 is placed above perforations 38 so that oil and/or water flows (arrow 39) into casing 31. Production pipe 34 has lateral flow line 35 at the well head. Valve 44 can be used to control flow in line 35. Arrow 36 in FIG. 2 indicates production of oil and gas through lateral flow line 35. However, in FIG. 2 there is also production (as indicated by arrow 43) through production tubing 42.

The production tubing 42 is a tubing that can be fitted inside of production pipe 34 as shown. Parallel tubes are as effective as the tube 42 inside the pipe 34 shown. The production pipe 34 is closed at 46 so that flow and production in the annulus 47 that is in between production tubing 42 and production pipe 34 must exit via lateral flow line 35, as shown by arrow 36 in FIG. 2. Fluid that is produced in production tubing 42 exits the top of production tubing 42 at arrow 43 in FIG. 2. This is a schematic representation for illustrative purposes. Actual field installed method would include a dual production wellhead or 'Christmas Tree'.

In FIG. 2, a production tube 42 of a smaller diameter than the existing production pipe 34 has been inserted inside of the production pipe 34, with both pipe 34 and tube 42 preferably having separate control valves at the wellhead. The liquid column 41 of oil and/or water achieves similar levels in both the tube 42 itself, and the annulus 47 between the pipe 34 and the tube 42. However, production now occurs from both the tube 42 and the annulus 47.

When the production valve 44 on the annulus 47 is closed, production is now limited to the production tube 42 only (see FIGS. 3–4). Because of the reduced cross sectional area of tube 42, and since it has the same inherent pressure drop and restriction due to the same height of its column of liquid, all of the hydrocarbon can be produced through tube 42, and the production velocity is greatly increased. This effect causes more of the liquid from the column in tube 42 to become entrained in the flowing hydrocarbon gas, starting to reduce the height of the liquid column (See FIG. 3).

As the height of this column is reduced, the flow rate increases, entraining even more liquid. As this process continues, the hydraulic characteristics inside the tube 42 change, as the continuous phase transitions from being the liquid, transitioning through some or all of the following states:

| | |
|---|---|
| 1. Bubble flow | (Liquid is continuous phase); |
| 2. Slug or Plug Flow | (Liquid is continuous phase); |
| 3. Foam or Froth Flow | (Vapor is continuous phase); |
| 4. Annular Flow | (Vapor is continuous phase); |
| 5. Spray Flow | (Vapor is continuous phase); |
| 6. Mist Flow | (Vapor is continuous phase). |

Figure 8:
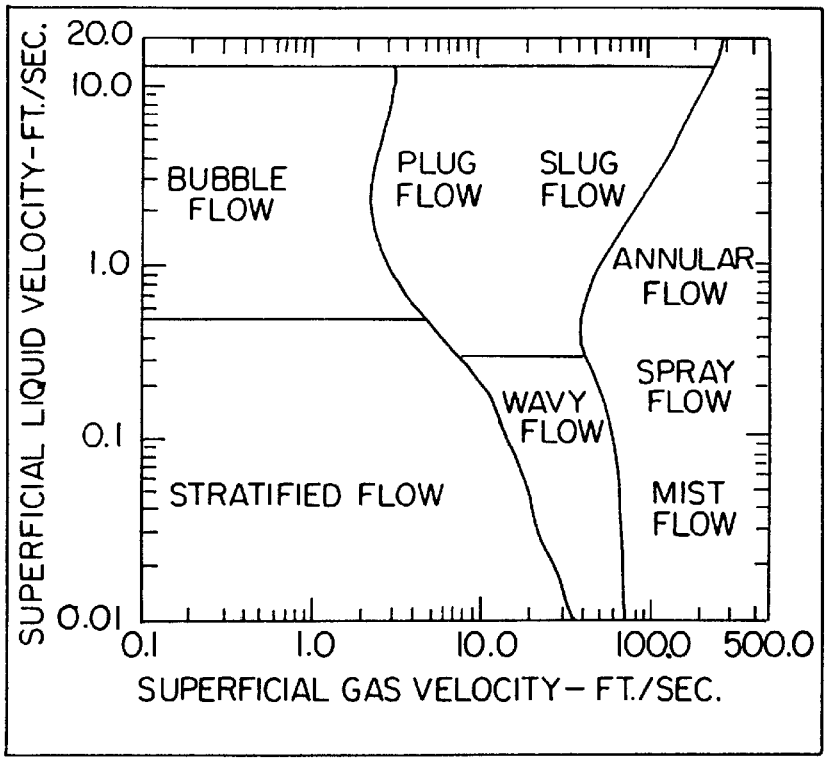
FIG. 8 is a graphical illustration displaying various horizontal flow regimes at given superficial liquid and superficial gas velocities.
Figure 9A:
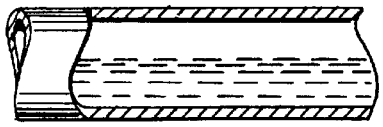
FIGS. 9A–H are sectional elevational view showing various types of flow in horizontal pipe.
Figure 9B:
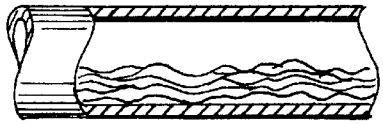
Figure 9C:
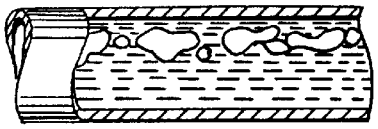
Figure 9D:
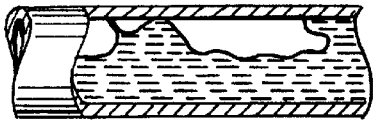
Figure 9E:
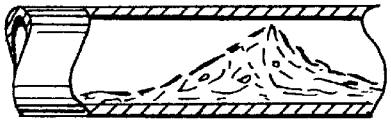
Figure 9F:
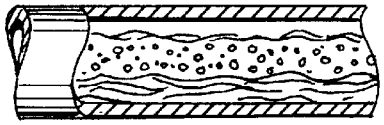
Figure 9G:
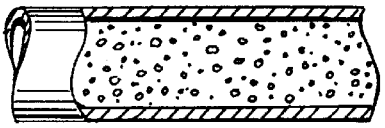
Figure 9H:
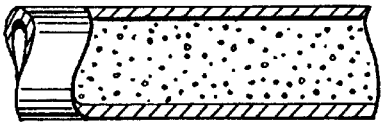

As it transitions, the overall pressure drop (because of the disappearing liquid column in the tube) decreases, and production increases. In FIG. 8, a graphical illustration is shown that displays various horizontal flow regimes at given superficial liquid and superficial gas velocities. In FIGS. 9A–9H, there are shown sectional, elevational views for various types of flow in horizontal pipe. These include stratified flow (FIG. 9A), wavy flow (FIG. 9B), bubble flow (FIG. 9C), plug flow (FIG. 9D), slug flow (FIG. 9E), annular flow (FIG. 9F), spray flow (FIG. 9G), and mist flow (FIG. 9H).

Figure 10:
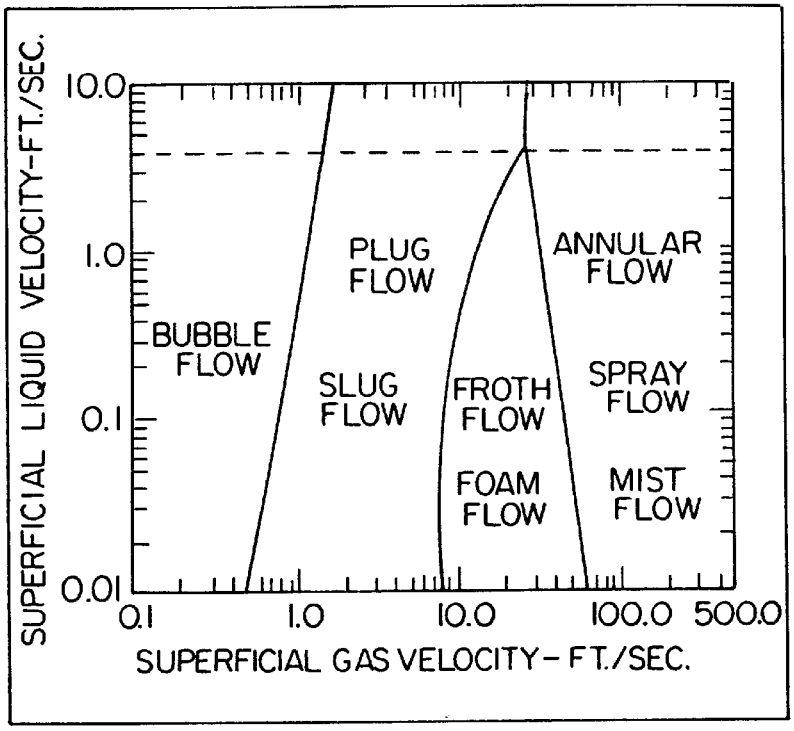
FIG. 10 is a graphical illustration displaying various vertical flow regimes at given superficial liquid and superficial gas velocities.
Figure 11A:
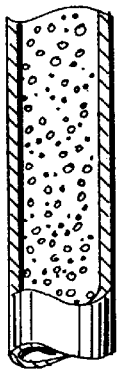
FIGS. 11A–11G are sectional elevational view showing various types of flow in vertical pipe.
Figure 11B:
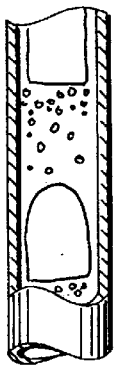
Figure 11C:
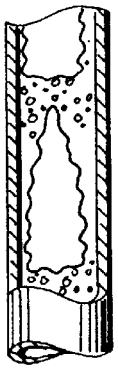
Figure 11D:
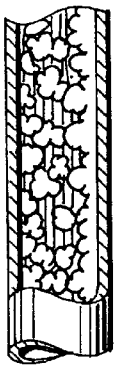
Figure 11E:
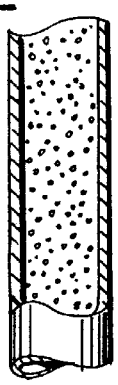
Figure 11F:
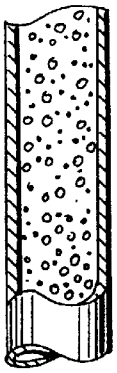
Figure 11G:
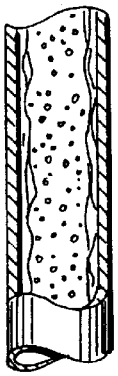

FIG. 10 is a graphical illustration that displays various vertical flow regimes at given superficial liquid and superficial gas velocities. FIGS. 11A–11G are sectional elevational views showing various regimes of flow in vertical pipe. These include bubble flow (FIG. 11A), plug flow (FIG. 11B), slug flow (FIG. 11C), foam and froth flow (FIG. 11D), mist flow (FIG. 11E), spray flow (FIG. 11F), and annular flow (FIG. 11G).

As the column of liquid in the production tube 42 at the wellhead reaches the well bottom, production rates reach a maximum possible through the tube with its given diameter (see FIG. 4). However, flowing pressure drop is higher than desired. One option is to close the valve on the production tube 42 to perform the same steps on the annulus 47.

Figure 5:
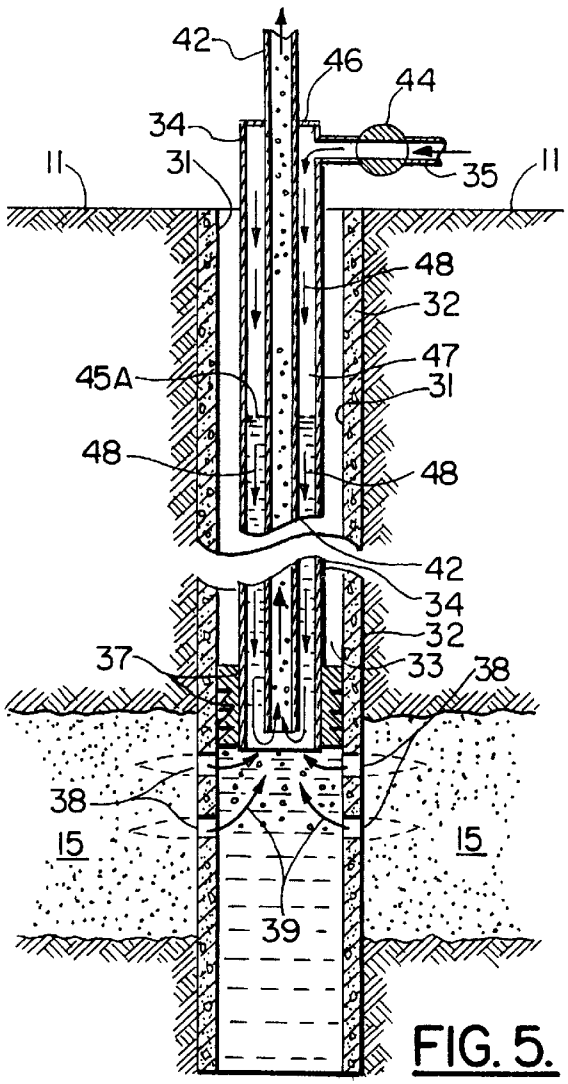
FIG. 5 is a sectional elevation view of a third embodiment of the apparatus of the present invention.
Figure 6:
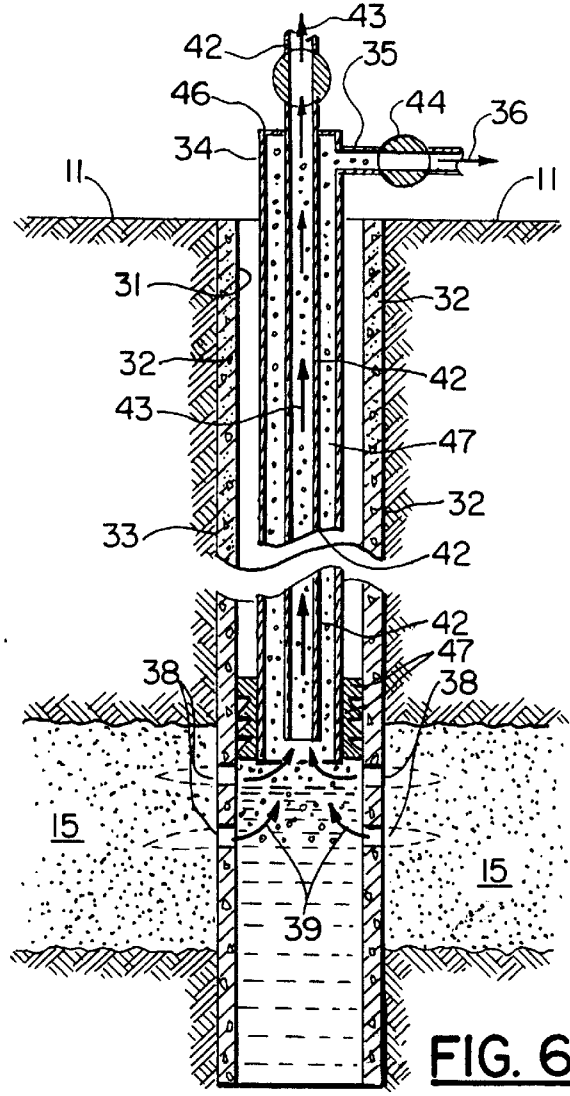
FIG. 6 is another sectional elevation view of the third embodiment of the apparatus of the present invention and showing the method of the present invention.

In the embodiment of FIGS. 5 and 6, gas makeup (to prevent vacuum by applying an "above atmospheric" pressure) is applied to the annulus 47 via flow line 35 with valve 44 open, helping the production gas flowing up the production tube 42 begin to entrain the liquid column now contained in the annulus 47.

Arrows 48 in FIG. 5 show the flow path of such gas makeup. As the liquid column 40 disappears, the production of entrained liquid at the wellhead will drop off, indicating the annulus 47 is dry (see FIG. 6).

In FIG. 6, both the valve on the production tube 42 and the valve 44 on the production pipe 34 and annulus 47 can be opened in order to again achieve maximum production flow, now that the liquid column 40 is removed. Since there is no liquid column 40 to cause excessive pressure drop, the gas flow should be much higher than originally experienced. In addition, because the flow is so high, liquid will have difficulty accumulating and reforming the liquid column in either the tube 42 or the annulus 47.

Figure 12:
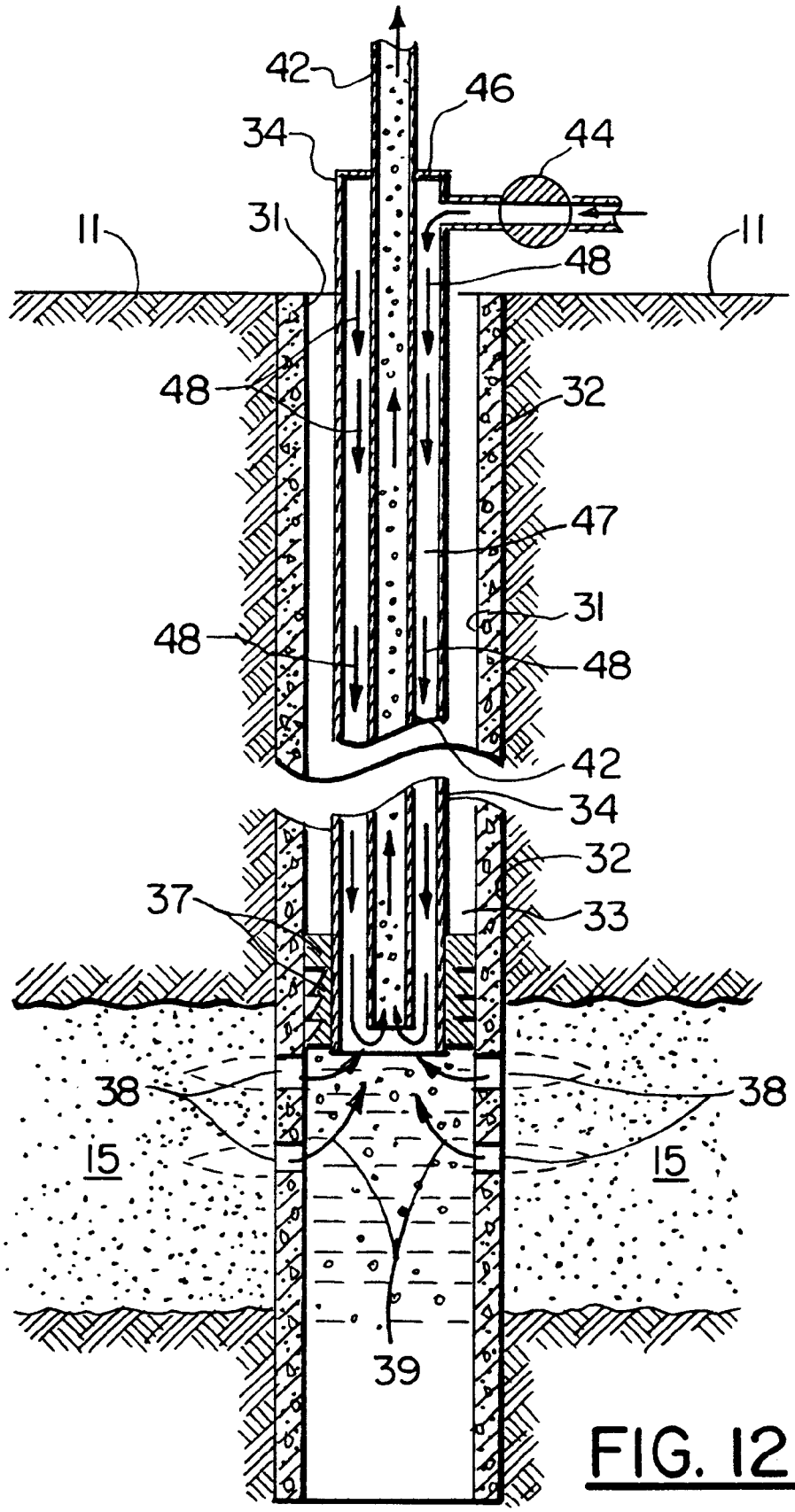
FIG. 12 is a sectional view of a fifth embodiment of the apparatus of the present invention.

As in FIG. 12, if the gas flow from the production sands 15 is not great enough or non-existent, production flow can be restricted to either the tubing 42 or the annulus 47. The preferred choice would be whichever best matches the resulting oil and/or water production from sands 15 in a gas-continuous stream. Supplemental gas flow can be fed to either the annulus 47 or the tubing 42, whichever is not used for production.

As an alternative (see FIG. 7), a smaller tube 42 could be chosen and placed beside the production pipe 34, and provide supplemental gas to the bottom of the well 30, keeping the velocity of the gas high (maintaining gas as continuous phase) and flowing out of the production pipe 34.

Although a second pipe or tube would be the preferred embodiment, other means could be used, such as using the annulus between the casing and the production pipe as the "second pipe or tube".

Figure 7:
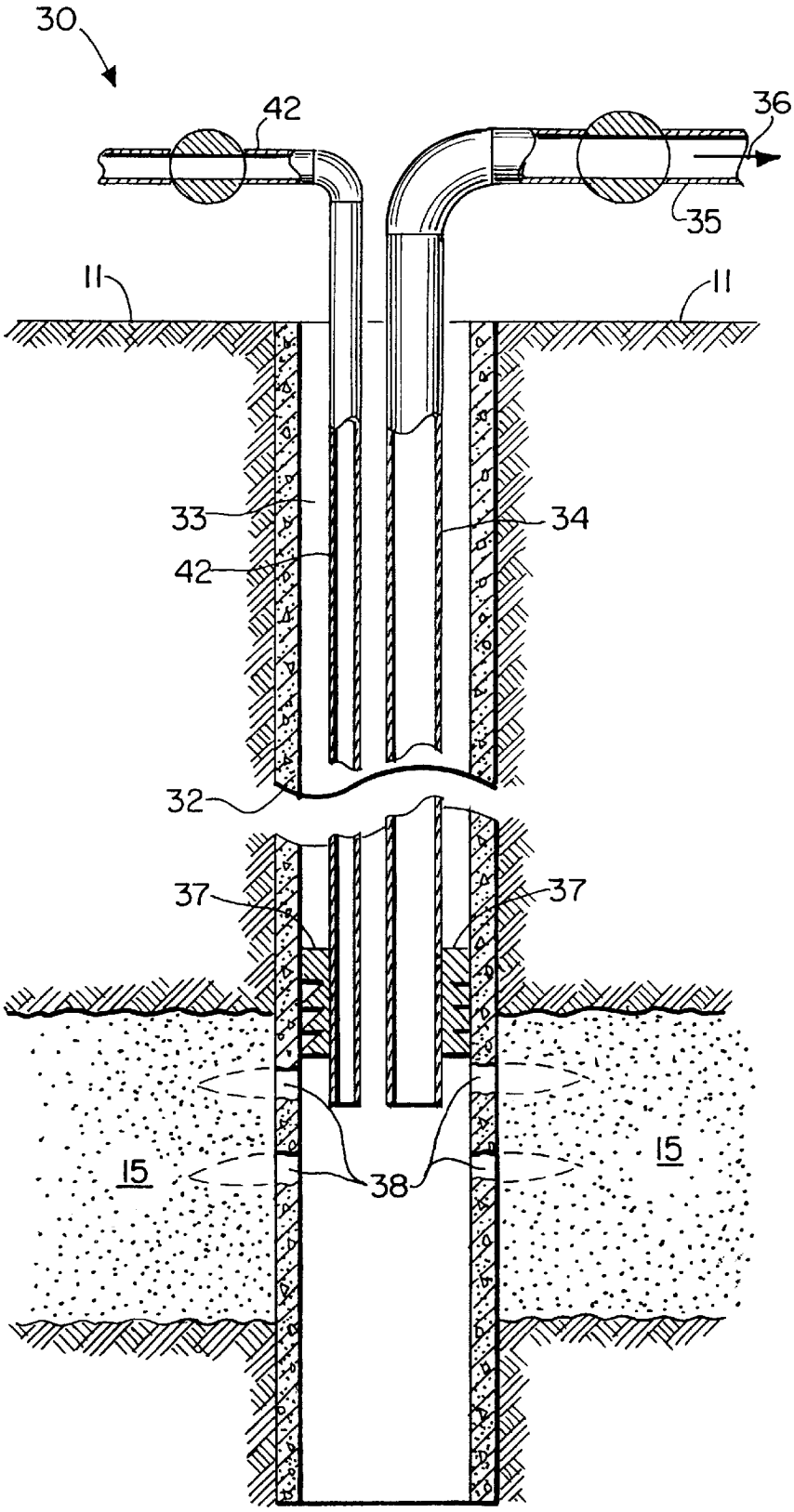
FIG. 7 is a sectional elevational view of a fourth embodiment of the apparatus of the present invention.

FIG. 7 shows a fourth embodiment of the apparatus of the present invention wherein the overall configuration is similar to that of FIGS. 2–6, FIG. 7 illustrating the use of a production pipe 34 and production tubing 42 that are parallel and positioned side by side.

The potential for accumulating liquid and building up a column of liquid reoccurs each time production is interrupted for any reason. If this happens, these above discussed method steps can be reapplied to bring the well 30 back into full production.

Also, the method could employ a smaller pipe or tubing in a "low gas flow well", and by using the method of the present invention, dramatically boost their production (even though constrained in a smaller pipe) without the use of a second pipe.

Another way to remove accumulated liquid from the production pipe is to simply pressure up the annulus between the casing and the production pipe, blowing out the liquid and then resuming well operations in the gas-continuous regime. Although the first four embodiments are the desired methods, this additional embodiment could be used to remove accumulated liquid from the production pipe. Thus, a user could dry out the production pipe by one of four ways:

1. pressure up the annulus between the casing and production pipe and blow out the liquid;
2. pressure up the production pipe, and "blow out" the liquid through the casing annulus;
3. use a production pipe and production tubing (or two pipes or two tubes) wherein a user pressures up the production tubing and blows out the liquid through the production pipe; or
4. use a production pipe and production tubing (or two pipes or two tubes) wherein a user pressures up the production pipe and blows out the liquid through the production tubing.

PARTS LIST

| PART NO. | DESCRIPTION |
|---|---|
| 10 | well |
| 11 | earth's surface |
| 12 | well casing |
| 13 | concrete layer |
| 14 | borehole |
| 15 | production sands |
| 16 | production pipe |
| 17 | lateral flow line |
| 18 | arrow |
| 19 | packer |

-continued

PARTS LIST

| PART NO. | DESCRIPTION |
|---|---|
| 20 | perforations |
| 21 | arrow |
| 22 | pressure reference point |
| 23 | pressure reference point |
| 24 | pressure reference point |
| 25 | pressure reference point |
| 26 | liquid level |
| 27 | liquid (water/oil) |
| 28 | gas bubbles |
| 29 | liquid droplets |
| 30 | well |
| 31 | well casing |
| 32 | concrete layer |
| 33 | borehole |
| 34 | production pipe |
| 35 | lateral flow line |
| 36 | arrow |
| 37 | packer |
| 38 | perforations |
| 39 | arrow |
| 40 | liquid (oil and/or water) |
| 41 | liquid level |
| 42 | production tubing |
| 43 | arrow |
| 44 | valve |
| 45A | liquid level |
| 45B | liquid level |
| 46 | closed end |
| 47 | annulus |
| 48 | arrows |

The foregoing embodiments are presented by way of example only; the scope of the present invention is to be limited only by the following claims.

What is claimed is:

1. A method of producing oil well fluid that includes one or more components that are oil, gas, and water with contained solids from a wellbore, comprising the steps of;

a) providing a wellbore that is lined with casing to provide an annulus and having a first production pipe inside the casing;

b) placing a second production pipe inside the wellbore;

c) introducing a gaseous flow towards the bottom of one of the production pipes at a rate of flow that is sufficient to produce a gas continuous-phase flow regime in at least a majority of the other production pipe, and at a pressure that is not less than atmospheric pressure.

2. The method of claim 1 wherein the gaseous flow in step "c" is introduced via an external injection source and may be either hydrocarbon or non-hydrocarbon.

3. The method of claim 1 wherein the gaseous flow in step "c" is introduced by production sands due to stimulation of low by reduced pressure drop within the well itself after removal of accumulated liquids.

4. The method of claim 1 wherein the gaseous flow in step "c" is introduced via an external injection source, combined with gaseous flow from production sands.

5. The method of claim 1 wherein the flow regime includes froth flow, a gas continuous phase flow regime.

6. The method of claim 1 wherein the flow regime includes foam flow, a gas continuous phase flow regime.

7. The method of claim 1 wherein the flow regime includes annular flow, a gas continuous phase flow regime.

8. The method of claim 1 wherein the flow regime includes spray flow, a gas continuous phase flow regime.

9. The method of claim 1 wherein the flow regime includes mist flow, a gas continuous phase flow regime.

10. The method of claim 1 wherein the casing has perforations at its lower end portion and in steps "a" and "b" the production pipes each has a lower end portion of at least one of the production pipes near the perforations.

11. The method of claim 1 further comprising the step of producing oil well fluid that includes one or more components that are oil, gas, and water with contained solids from one of the production pipes while the gaseous flow is being introduced towards the bottom of the other production pipe.

12. The method of claim 1 wherein the casing has a lower end portion with perforations and in steps "a" and "b" the production pipes each has a lower end portion and further comprising the step of positioning the lower end of at least one of the production pipes above the perforations.

13. The method of claim 1 wherein in steps "a" and "b" the pipes are at least partially filled with oil well fluid that includes one or more components that are oil, gas, and water with contained solids.

14. The method of claim 1 wherein a sufficient amount of gas is introduced in step "c" so that the buildup of fluids in the production pipe that is producing oil well fluid is prevented.

15. The method of claim 1 wherein the casing has a lower end portion with perforations and in steps "a" and "b" the production pipes each has a lower end portion and further comprising the step of positioning the lower end of at least one of the production pipes below the perforations.

16. A method of producing oil well fluid that includes one or more components that are oil, gas, and water with contained solids from a wellbore, comprising the steps of;

a) providing a wellbore that is lined with casing and having a first production pipe inside the casing;
b) placing a second production pipe inside the first production pipe wherein the space between the pipes defines an annulus;
c) introducing a gaseous flow towards the bottom of the production pipes at a rate of low that is sufficient to produce a gas continuous-phase flow regime in at least a majority of the other production pipe, and at a pressure that is not less than atmospheric pressure.

17. The method of claim 16 wherein the gaseous flow in step "c" is introduced via an external injection source.

18. The method of claim 16 wherein the gaseous flow in step "c" is introduced by production sands due to stimulation of flow by reduced pressure drop within the well itself after removal of accumulated liquids.

19. The method of claim 16 wherein the gaseous flow in step "c" is introduced via an external injection source, combined with gaseous flow from production sands.

20. The method of claim 16 wherein the flow regime includes froth flow, a gas continuous phase flow regime.

21. The method of claim 16 wherein the flow regime includes foam flow, a gas continuous phase flow regime.

22. The method of claim 16 wherein the flow regime includes annular flow, a gas continuous phase flow regime.

23. The method of claim 16 wherein the flow regime includes spray flow, a gas continuous phase flow regime.

24. The method of claim 16 wherein the flow regime includes mist flow, a gas continuous phase flow regime.

25. The method of claim 16 wherein the casing has perforations at its lower end portion and in steps "a" and "b" the pipes each had a lower end portion and further comprising the step of positioning at least one of the lower end portions of the production pipes near the perforations.

26. The method of claim 16 further comprising the step of producing oil well fluid that includes one or more components that are oil, gas, and water with contained solids from a one of the production pipes while the gaseous flow is being introduced towards the bottom of the other production pipe.

27. The method of claim 16 wherein the casing has a lower end portion with perforations and in steps "a" and "b" the production pipes each has a lower end portion and further comprising the step of positioning the lower end portion of at least one of the production pipes above the perforations.

28. The method of claim 16 wherein in steps "a" and "b" the pipes are at least partially filled with oil well fluid that includes one of more components that are oil, gas, and water with contained solids.

29. The method of claim 16 wherein a sufficient amount of gas is introduced in step "c" so that the buildup of fluids in the production pipe that is producing oil well fluid is prevented.

30. The method of claim 16 wherein the casing has a lower end portion with perforations and in steps "a" and "b" the production pipes each has a lower end portion and further comprising the step of positioning the lower end of at least one of the production pipes below the perforations.

31. A method of producing oil well fluid that included one or more components that are oil, gas and water with contained solids from a wellbore, comprising the steps of;

a) providing a wellbore that is lined with casing to provide an annulus and having multiple production pipes inside the casing, one or more of the production pipes defining a first production pipe;
b) one or more of the other production pipes defining a second production pipe;
c) introducing a gaseous flow towards the bottom of the production pipes at a rate of flow that is sufficient to produce a gas continuous-phase flow regime in at least a majority of the other production pipe, and at a pressure that is not less than atmospheric;
d) producing oil, gas, and/or water with contained solids selectively through one or more or all of the production pipes; and
e) wherein in step "d" some of all of the production pipes(s) are valved so that some or all valves can be closed so that the production of oil, gas, and/or water with contained solids is via one or more of the other(s).

32. The method of claim 31 wherein the gaseous flow in step "c" is introduced via an external injection source and may be either hydrocarbon or non-hydrocarbon.

33. The method of claim 31 wherein the gaseous flow in step "c" is introduced by producing sands due to stimulation of flow by reduced pressure drop within the well itself after removal of accumulated liquids.

34. The method of claim 31 wherein the gaseous flow in step "c" is introduced via an eternal injection source, combined with gaseous flow from production sands.

35. The method of claim 31 wherein the flow regime includes froth flow, a gas continuous phase flow regime.

36. The method of claim 31 wherein the flow regime includes foam flow, a gas continuous phase flow regime.

37. The method of claim 31 wherein the flow regime includes annular flow, a gas continuous phase flow regime.

38. The method of claim 31 wherein the flow regime includes spray flow, a gas continuous phase flow regime.

39. The method of claim 31 wherein the flow regime includes mist flow, a gas continuous phase flow regime.

40. The method of claim 31 wherein the casing has perforations at its lower end portion and in steps "a" and "b" the production pipes each has a lower end portion and further comprising the step of positioning a lower end portion of at least one of the production pipes near the perforations.

41. The method of claim 31 further comprising the step of producing oil well fluid that includes one or more components that are oil, gas, and water with contained solids from one of the production pipes while the gaseous flow is being introduced towards the bottom of the other production pipe.

42. The method of 31 wherein the casing has a lower end portion with perforations and in steps "a" and "b" the production pipes each has a lower end portion of at least one of the production pipes above the perforations.

43. The method of claim 31 wherein in steps "a" and "b" the pipes are at least partially filled with oil well fluid that includes one or more components that are oil, gas, and water with contained solids.

44. The method of claim 31 wherein a sufficient amount of gas is introduced in step "c" so that the buildup of fluids in the production pipe that is producing oil well fluid is prevented.

45. The method of 31 wherein the casing has a lower end portion with perforations and in steps "a" and "b" the production pipes each has a lower end portion and further comprising the step of positioning the lower end of at least one of the production pipes below the perforations.

* * * * *